US009460594B1

(12) United States Patent
Groth et al.

(10) Patent No.: US 9,460,594 B1
(45) Date of Patent: Oct. 4, 2016

(54) APPARATUS, SYSTEM AND METHOD FOR POSITIONING A CABLE WITH A SENSOR BY A ROTATABLE CABLE ASSEMBLY

(71) Applicant: Sennco Solutions, Inc., Plainfield, IL (US)

(72) Inventors: Jim Groth, Poplar Grove, IL (US); Andy Reynolds, Aurora, IL (US); Daniel Horvath, Plainfield, IL (US)

(73) Assignee: Sennco Solutions Inc., Plainfield, IL (US)

( * ) Notice: Subject to any disclaimer, the term of this patent is extended or adjusted under 35 U.S.C. 154(b) by 0 days.

(21) Appl. No.: 14/641,997

(22) Filed: Mar. 9, 2015

(51) Int. Cl.
*G08B 13/12* (2006.01)
*G08B 13/14* (2006.01)

(52) U.S. Cl.
CPC ..... *G08B 13/1463* (2013.01); *G08B 13/1409* (2013.01); *G08B 13/1418* (2013.01); *G08B 13/1445* (2013.01)

(58) Field of Classification Search
CPC . G06F 21/88; G06F 1/1632; G08B 13/1445; G08B 13/1418; G08B 13/1463
USPC ..... 340/568.3, 568.2, 568.4, 568.1
See application file for complete search history.

(56) References Cited

U.S. PATENT DOCUMENTS 6,459,374 B1 * 10/2002 Rand ..... G08B 13/1418 340/568.2
7,209,038 B1 * 4/2007 Deconinck ..... G08B 13/1409 340/541
7,327,276 B1 * 2/2008 Deconinck ..... G08B 13/1409 340/568.8
7,384,304 B1 * 6/2008 Fawcett ..... H01R 13/6395 439/567
7,626,500 B2 * 12/2009 Belden, Jr. ..... E05B 45/005 340/568.1
7,639,133 B1 * 12/2009 Kelsch ..... G08B 13/1445 340/545.6
8,408,932 B2 * 4/2013 Villarreal ..... H01R 13/6275 439/358
8,847,759 B2 * 9/2014 Bisesti ..... G08B 13/1463 340/568.1
9,105,167 B2 * 8/2015 Fawcett ..... G08B 13/1418
9,298,219 B2 * 3/2016 Gulick, Jr. ..... G06F 1/1632
2004/0003937 A1 * 1/2004 Vans Evers ..... H01B 11/12 174/113 R
2006/0220880 A1 * 10/2006 Yasur ..... G08B 13/1445 340/573.1
2008/0105007 A1 * 5/2008 Tracy ..... E05B 73/0005 70/58
2008/0169923 A1 * 7/2008 Belden ..... A47F 7/024 340/568.3
2009/0001707 A1 * 1/2009 Brooks ..... B65C 3/02 283/81
2009/0095398 A1 * 4/2009 Hardin ..... B65C 3/02 156/52
2010/0238031 A1 * 9/2010 Belden, Jr. ..... G08B 25/008 340/568.1
2011/0047844 A1 * 3/2011 Fawcett ..... G08B 13/1445 40/642.02
2012/0019383 A1 * 1/2012 Fawcett ..... G08B 13/1463 340/568.1

(Continued)

*Primary Examiner* — Hoi Lau
(74) *Attorney, Agent, or Firm* — Lempia Summerfield Katz LLC

(57) ABSTRACT

An apparatus, a system and a method positions a cable extending from an alarm system through a housing to face the cable toward the rear of an electronic device to which the cable is attached. The housing has a sensor assembly that holds a light visible through the sensor assembly to denote an alarm condition. A sensor associated with the sensor assembly connects to a corresponding sensor port in the electronic device. A joint attached to the sensor assembly rotates to position the cable. Detachment of the sensor from the port in the electronic device disrupts a circuit formed between the alarm system, the cable and the electronic device to activate the alarm condition.

20 Claims, 4 Drawing Sheets

(56) References Cited

U.S. PATENT DOCUMENTS

2012/0099256 A1* 4/2012 Fawcett ..... G08B 13/1445 361/679.01
2012/0120571 A1* 5/2012 Bisesti ..... G08B 13/1463 361/679.01
2012/0188082 A1* 7/2012 Berglund ..... G08B 13/1445 340/568.2
2012/0192600 A1* 8/2012 Johnston ..... A47F 7/024 70/58
2012/0217371 A1* 8/2012 Abdollahzadeh ... E05B 15/1607 248/551
2012/0293330 A1* 11/2012 Grant ..... G08B 13/1427 340/568.8
2013/0149893 A1* 6/2013 Bisesti ..... H01R 31/06 439/502
2013/0241731 A1* 9/2013 Fawcett ..... G08B 13/1463 340/568.2
2013/0257616 A1* 10/2013 Taylor ..... G08B 21/0225 340/568.2
2014/0035747 A1* 2/2014 Ewen, III ..... G08B 13/1418 340/568.2
2014/0062698 A1* 3/2014 Fawcett ..... G08B 13/1418 340/568.3
2014/0152440 A1* 6/2014 Berglund ..... G08B 13/1463 340/568.2
2015/0028145 A1* 1/2015 Johnston ..... A47F 7/024 242/390.8
2015/0089675 A1* 3/2015 Gulick, Jr. ..... G06F 1/1632 726/35
2015/0091729 A1* 4/2015 Phillips ..... G08B 13/1427 340/568.2
2015/0235533 A1* 8/2015 Grant ..... G08B 13/1445 340/568.2
2015/0310711 A1* 10/2015 Fawcett ..... G08B 13/1418 340/568.3
2016/0042619 A1* 2/2016 Conaty ..... G08B 13/1409 340/568.4
2016/0055732 A1* 2/2016 Howard ..... G08B 21/0272 340/539.13

* cited by examiner

APPARATUS, SYSTEM AND METHOD FOR POSITIONING A CABLE WITH A SENSOR BY A ROTATABLE CABLE ASSEMBLY

BACKGROUND OF THE INVENTION

The present invention relates to an apparatus, a system and a method for positioning, securing, attaching and/or detaching a cable with a, sensor, such as, for example, a Universal Serial Bus (hereinafter "USB") sensor to an electronic device by a cable assembly which may rotate to an angle from an original position to orient the cable away from the electronic device. More specifically, the present invention positions the cable with the sensor to face the rear of an electronic device such as a camera, a smart phone, a laptop or tablet computer, an E-book, an E-reader, and/or the like. The electronic device may be displayed in, for example, in an uncluttered manner by positioning the cable toward the rear of the device. The device may be portable and, for example, displayed for sale by a retailer, a wholesaler and/or the like.

Vendors, retailers and/or wholesalers may display a device to a customer at, for example, a retail store for evaluation by the customer. The device may be displayed with a fixture, such as, for example, a wall, a floor, a pillar, a support beam, a stair case, a cabinet, a table, a shelf and/or the like.

Generally, electronic devices such as laptop computers have sleek, smooth and/or otherwise uninterrupted design lines. A cable, such as a power cable, extends from a power source and/or an alarm system to insert into a corresponding port, such as a sensor port, located on the electronic device, to provide power to the electronic device. Positioning the cable away from the front of the device allows customers to access the electronic device. Cables may protrude from the device, cross over the device, become entangled with the device, and/or otherwise impede access to the device.

A need, therefore, exists for an apparatus, a system and a method for positioning, securing, attaching and/or detaching a cable with a sensor to an electronic device via a cable assembly which may rotate from a position to orient the cable to face the rear of the electronic device to which the cable is attached.

SUMMARY OF THE INVENTION

The present invention relates to an apparatus, a system and a method for positioning, securing, attaching and/or detaching a cable, such as a power cable, with a sensor to an electronic device via a cable assembly. Examples of devices may include a camera, a smart phone, a laptop or tablet computer, an E-book, an E-reader, and/or the like. Further, the cable assembly may have a body with a bottom, a digital key connector assembly, a sensor assembly, a switch such as, for example, a switch with a plunger, a sensor, such as a sensor, a light, such as a LED light, mounted in the sensor assembly, and a joint. A disruption of a circuit formed by the connection of a cable with the sensor to the electronic device through the cable assembly may be detected to activate, for example, an alarm condition.

To this end, in an embodiment of the present invention, an apparatus for connecting a sensor assembly from an alarm system to an electronic device by a cable to complete a circuit between the sensor assembly, the electronic device is provided. A disruption of the circuit causes the alarm system to activate an alarm condition. The apparatus has a cable assembly with a groove along an interior of the cable assembly. A joint attaches the cable assembly to a housing. The joint rotates to position the cable through the groove of the cable assembly to face the electronic device. A connector attaches to the cable and the connector inserts into the alarm system. A sensor in the sensor assembly connects to a port in the electronic device.

In an embodiment of the invention, the apparatus has a light in the housing that illuminates through the body to indicate the alarm-ready condition of the circuit.

In an embodiment of the invention, the apparatus has a base section that covers the cable.

In an embodiment of the invention, the apparatus has a top cover and a bottom cover wherein the top cover inserts into the bottom cover to form the cable assembly.

In an embodiment of the invention, the apparatus has a cap that fits in an opening in a base positioned opposite to the cap to form the housing.

In an embodiment of the invention, the apparatus has a coiled section that reduces a length of the cable wherein the cable extends from the alarm system to connect with the electronic device.

In an embodiment of the invention, an identifying label may be applied to the cable wherein the identifying label may be a "heat-shrink" type label, i.e. where a pre-formed label may expand upon heating to be applied to a surface and shrink to a desired size on the surface upon later cooling.

In another embodiment of the present invention, a system for connecting a sensor to an electronic device is provided. The system has a cable routed through a housing. The cable has a length defined between a first end and a second end. The first end has the sensor that inserts into a port in the electronic device. The second end has a connector that inserts into an alarm system to define a circuit between the cable, the electronic device and the alarm system. A hinge joint is located at one end of the housing. The hinge joint rotates to position the cable away from the electronic device. A light is mounted in the housing. The light illuminates upon insertion of the cable into the alarm system and the port in the electronic device to signify an alarm ready condition of the circuit.

In an embodiment of the invention, the system has an alarm activated by disruption of the circuit.

In an embodiment of the invention, the system has a conductor cord in the cable to supply power to the electronic device from the alarm system.

In an embodiment of the invention, the system has a label that provides identifying information regarding the cable wherein the label is attached to the cable.

In an embodiment of the invention, the system has an alarm activated by removal of the connector from the port in the electronic device.

In an embodiment of the invention, the system has a plunger switch in the housing wherein depression of the plunger switch closes the circuit.

In yet another embodiment of the present invention, a method for connecting a cable from an alarm system to an electronic device to complete a circuit between the alarm system, the cable and the electronic device is provided. A disruption of the circuit causes the alarm system to activate an alarm condition. The method includes identifying a port on the electronic device and connecting the cable to the alarm system. The cable is routed through a housing wherein the housing rotates to position the cable away from the electronic device. A sensor associated with the housing is connected to the port. The alarm condition deactivates the electronic device.

In an embodiment of the invention, the method includes activating an alarm condition upon removal of the sensor from the port.

In an embodiment of the invention, the method includes illuminating the sensor in the housing to signify the alarm condition.

In an embodiment of the invention, the method includes disrupting the circuit to activate the alarm condition upon removal of the cable from the alarm system.

In an embodiment of the invention, the method includes deactivating the sensor prior to detaching the sensor from the port.

In an embodiment of the invention, the method includes activating the alarm system to create an alarm-ready condition.

In an embodiment of the invention, the method includes depressing a plunger switch to close the circuit.

Additional features and advantages of the present invention are described in, and will be apparent from, the detailed description of the presently preferred embodiments and from the drawings.

DETAILED DESCRIPTION

Figure 1:
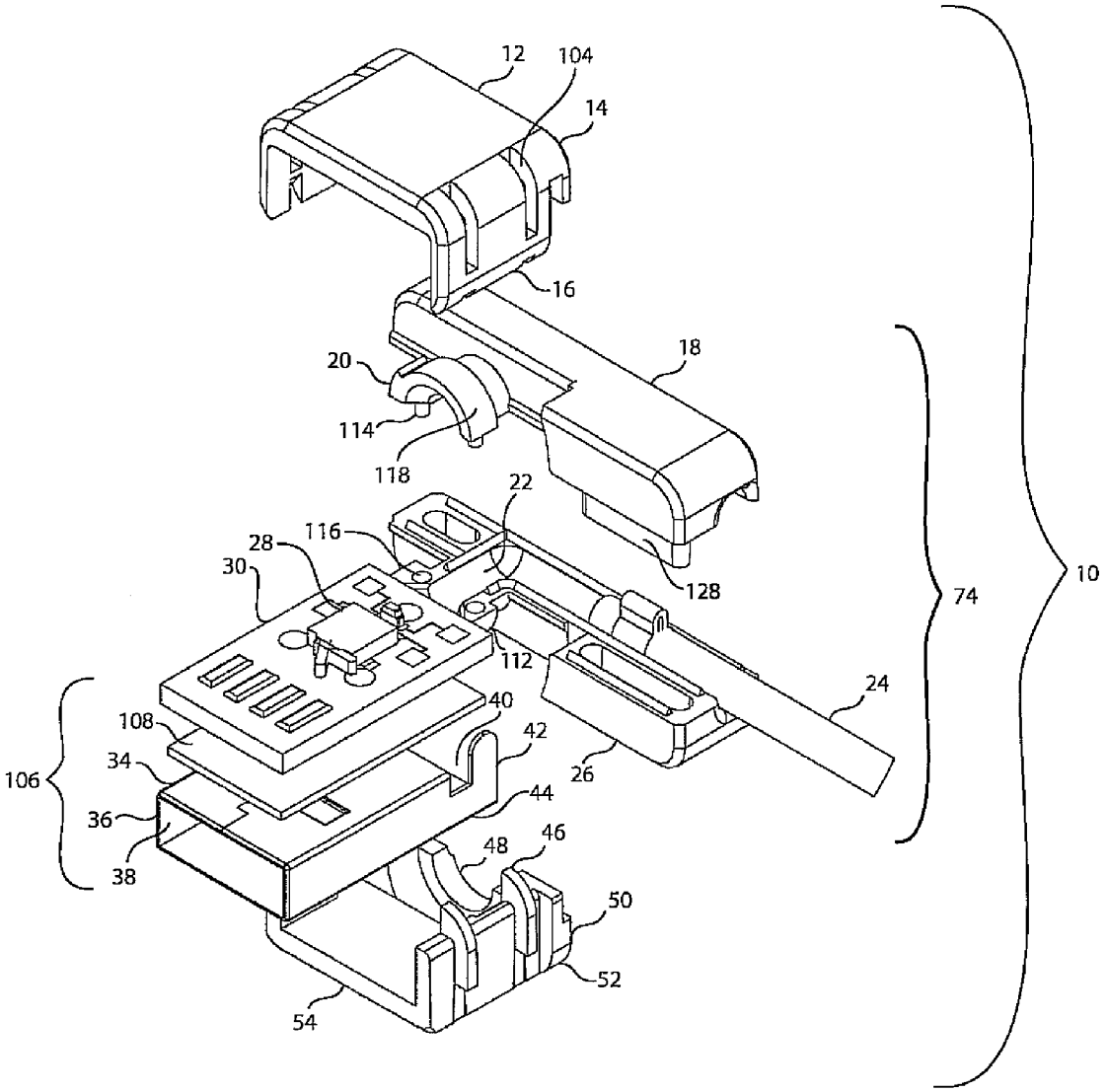
FIG. 1 illustrates an exploded view of an assembly housing a sensor in accordance with an embodiment of the present invention.

Embodiments disclosed herein are applicable to a cable assembly that may rotate to an angle from an original position to orient a cable away from the electronic device to which the cable is attached. While specific embodiments may be described as utilized in the consumer electronics and related industries, the cable positioning device may be applicable in other industries where the positioning of a cable with a sensor and/or other peripheral may be desirable. The embodiments, for example, may be utilized in a retail setting having displayed devices.

In the following detailed description, reference is made to accompanying drawings, which form a part thereof. In the drawings, similar symbols or identifiers typically identify similar components, unless context dictates otherwise. The illustrative embodiments described herein are not meant to be limiting. Other embodiments may be utilized, and other changes may be made, without departing from the spirit or scope of the subject matter presented. It will be readily understood that the aspects of the present disclosure, as generally described herein, and illustrated in the figures, may be arranged, substituted, combined and designed in a wide variety of different configurations, which are contemplated and form part of this disclosure.

Figure 7:
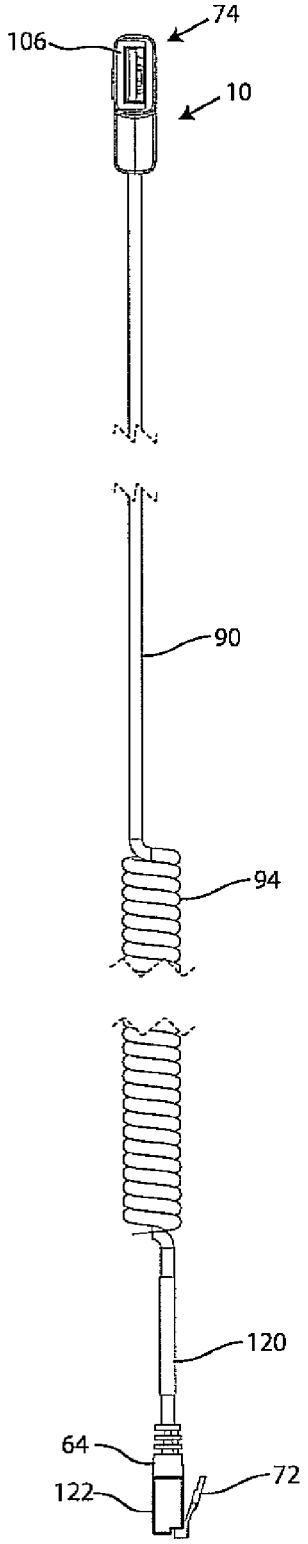
FIG. 7 illustrates a side view of a cable with a sensor and a cable assembly in accordance with an embodiment of the present invention.
Figure 8:
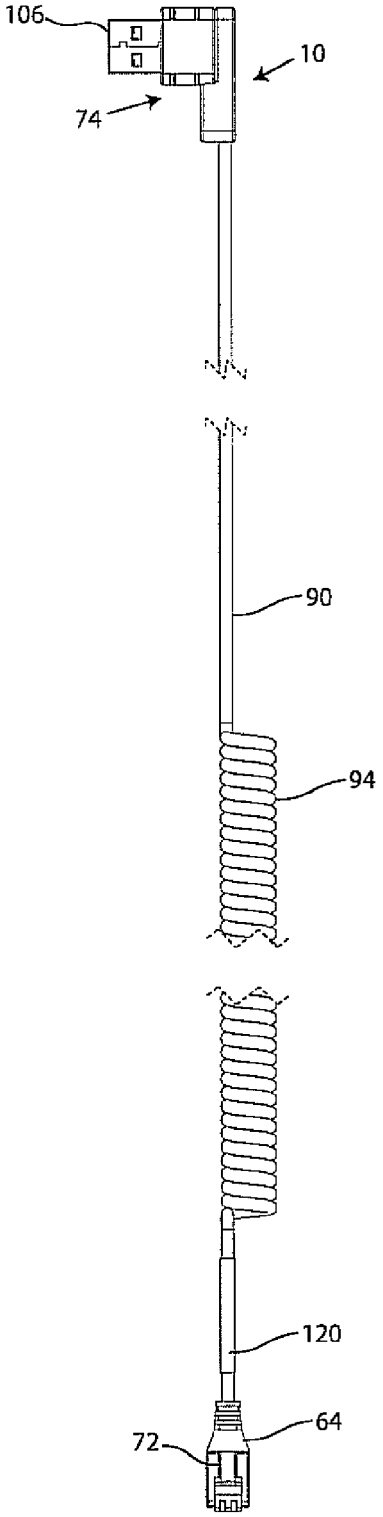
FIG. 8 illustrates a top view of a cable with a sensor and a cable assembly in accordance with an embodiment of the present invention.

Referring now to the drawings wherein like numerals refer to like parts, FIG. 1 illustrates an exploded view of an apparatus 10 which may accept and/or receive a cable 90, as shown in FIGS. 7 and 8, through a passageway, pipe and/or a conduit 24. The apparatus 10 may have a base 54 with a side 50 which may be attached to the base at, for example, a corner section 52. The side 50 may have a protrusion 46 that may extend from the side 50 to insert into a complementary orifice 104 in a top cap 12 to attach the top cap 12 to the base 54 to complete and/or form the apparatus 10. Further, in an embodiment, the top cap 12 may have a section 16 that may assist fitment of the top cap 12 to the base 54.

Figure 2:
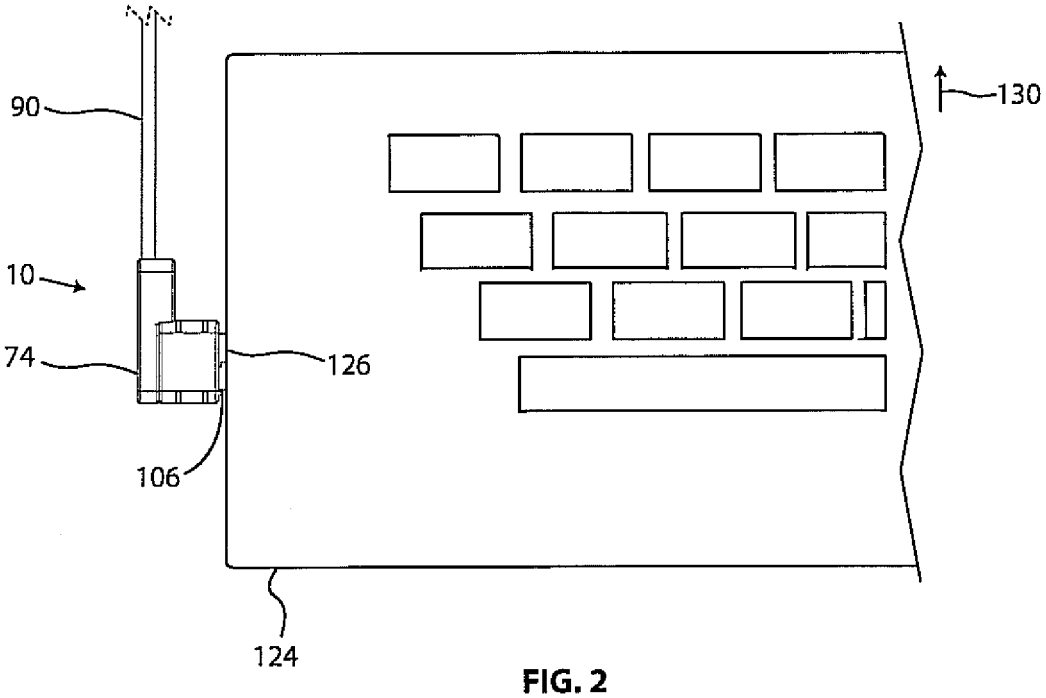
FIG. 2 illustrates a top view of a sensor assembly attached to the left side of a laptop computer in accordance with an embodiment of the present invention.
Figure 3:
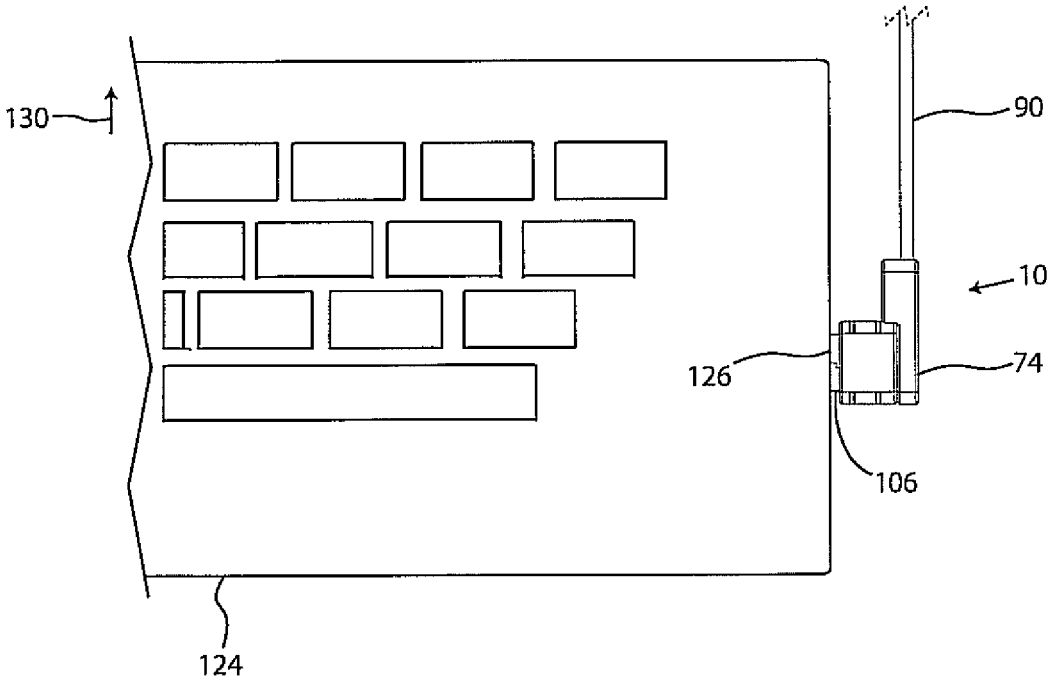
FIG. 3 illustrates a top view of a sensor assembly attached to the right side of a laptop computer in accordance with an embodiment of the present invention.

A sensor assembly 106, such as, for example, including a USB sensor, also referred to as a digital key connector assembly and/or a "Digi-Key" ®, registered trademark of Digi-Key Corp., type electronic component and/or connector may be mounted on and/or in the base 54 as shown in, for example, FIG. 1. A cable 90, as shown in FIGS. 7 and 8, may attach to the sensor assembly 106 which may insert into a port 126, such as, for example, a port configured to receive a USB sensor, in a laptop computer 124, as shown in FIGS. 2 and 3, to complete a circuit between the cable 90, an alarm system to which the cable 90 may be attached, and the laptop computer 124. Removal of the sensor assembly 106 from the port 126 may disrupt the circuit to activate an alarm condition. The sensor assembly 106 may have a housing 36 with an opening 38 that may be configured to engage with and/or accept various electronic components associated with the port 126, as shown in FIGS. 2 and 3, to complete a connection of the sensor assembly 106 to an electronic device such as a laptop computer 124. The housing 36 may have a side 34 positioned and/or oriented parallel to the side 50 of the base 54.

An intermediate piece 108 may be positioned on and/or adhered to a top surface 34 of the housing 36. A circuit board 30 may be fixed to and positioned on top of the intermediate piece 108. In an embodiment, the circuit board 30 may assist in data interfacing and/or communication via the sensor assembly 106, an alarm system, and an electronic device, such as the laptop 126. Various electronic components 28 may be positioned in and/or on the sensor assembly 106 for data processing and/or transfer. In an embodiment, the various electronic components 28 may have a light-emitting diode (hereinafter "LED") light mounted in the sensor assembly 106. The LED light may illuminate upon connection of the cable 90 into an alarm system and the port 126 in an electronic device such as the laptop computer 124, as shown in FIGS. 2 and 3, to signify an alarm ready condition. Also, the various electronic components may have a switch, such as a switch with a plunger that may be depressed, for example, to complete a circuit to assist in the detection an interior of the sensor assembly 106.

The sensor assembly 106 may connect with the cable 90 to allow for data interfacing and/or communication between electronic devices, such as an alarm system and/or a laptop computer. In an embodiment, the cable 90 may be a power cord and/or cable that may also supply electricity and/or power to the sensor assembly from a traditional wall socket and/or a power source associated with an alarm system, for example.

The cable 90 may be associated with the conduit 24 to connect to the sensor assembly 106 as, for example, shown in FIG. 1. The conduit 24 may be surrounded by a left-side sheath and/or cover 26 and/or a right-side sheath and/or cover 18 that may accept the cable 90 and/or feed the cable 90 to the sensor assembly 106 via a groove shaped as, for example, an elbow 22. Connection of the cable into an alarm system and/or an electronic device such as a laptop computer may define a circuit. The circuit may be an electronic circuit that may be opened and/or closed by depression of a switch that may be mounted in, for example, the housing 36. The switch may complete a circuit to assist in the detection of an inside area and/or region of the port in the electronic device, for example. The switch may also close a circuit, such as an open circuit, formed by the connection of the cable 90 to an alarm system and/or a port in an electronic device. Disruption of the circuit by, for example, removing the sensor assembly 106 from the port 126 in the electronic device and/or removing the cable 90 from an alarm system may activate an alarm condition.

In an embodiment, one or more of the various components of the apparatus 10, such as the base 54, the housing 36, and/or the top sheath and/or cover 12, may be constructed from plastic, metal, a composite and/or any other substantially rigid material and/or combination thereof. As shown in FIG. 1, the left-side sheath and/or cover 26 and/or the right-side sheath and/or cover 18 may have hollow sections to reduce weight and/or to enhance structural rigidity of the apparatus 10, for example.

A ridge 128 may extend from an underside of the right-side sheath and/or cover 18 to insert into an orifice 110 in the left-side sheath and/or cover 26 to connect, attach and/or bind the right-side sheath and/or cover 18 to the left side sheath and/or cover 26 to form a cable assembly 74. A right-side semi-circular connector piece 20 may be located on the right-side sheath and/or cover 18. Likewise, a left-side semi-circular connector piece 112 may be located on the left-side sheath and/or cover 26. The right-side semi-circular connector piece 20 may interface and/or engage with the left-side semi-circular connector piece 112 to form a hinge joint 118 upon insertion of knobs 114 into holes 116 as shown in FIG. 1, for example.

An advantage offered by the apparatus 10 is the ability to rotate the cable 90, which may be routed through the cable assembly 74, about an axis defined by the hinge joint 118. In an embodiment, the angle at which the cable 90 is rotated through the cable assembly 74 may be up to one-hundred and eighty degrees (180°).

The hinge joint 118 may insert into an arc-shaped holder 48 that may be designed to accept insertion of the hinge joint 118. The hinge joint 118 may assist in the rotation of the cable assembly 74 to rotate about an axis defined by the hinge joint 118 to attach of the sensor assembly 106 to an electronic peripheral such as a laptop computer 124, as shown in FIGS. 2 and 3.

In an embodiment, the apparatus 10 may allow for the rotation of the cable assembly 74 to accommodate insertion of the sensor assembly 106 into a port 126 located on the left of the laptop computer as shown in FIG. 2. Alternatively, the cable assembly 74 may be rotated about an axis defined by the hinge joint 118 to accommodate insertion of the sensor assembly 106 on the right of the laptop computer 124 as shown in FIG. 3. The cable 90 may be directed to face a direction 130, as shown in FIGS. 2 and 3, of the laptop computer 124 and/or device via the rotation of the hinge joint 118. Thus, the cable 90 may be positioned to permit for display and/or to accommodate consumer interaction. Such positioning may be desirable for creating an uncluttered appearance of the electronic device, such as a laptop 124, without negatively impacting the alarm functionality from attachment of the sensor assembly 106 to a corresponding port on the electronic device 126. Removal of the sensor assembly 106 from the port 126 may activate an alarm condition when the cable 90 is connected to an alarm system.

In an embodiment, the various electronic components 28 may have a light emitting diode (hereinafter "LED") that may emit light through the sensor assembly 106 and/or the apparatus 10 to denote an active alarm-ready condition, for example, when the cable 90 is plugged into and/or connected to an alarm system.

Referring now to FIGS. 2 and 3, an electronic device, such as the laptop computer 124, is shown with the port 126 located on a left side and/or right side of the laptop 124 relative to the direction 130. In an embodiment, the direction 130 may point toward the rear of the laptop 124. The apparatus 10 may be positioned at a location adjacent to the port 126 on the left side and/or the right side of the laptop computer 124.

The cable assembly 74 may be rotated about an axis defined by the hinge joint 118, if needed, to accommodate the insertion of the sensor assembly 106 into the port 126 to initiate and/or further facilitate data communication and/or power delivery through the cable 90. The cable 90 may extend from the apparatus 10 toward the direction 130 to provide for an uncluttered appearance of the laptop computer 124. A neat and/or uncluttered appearance of the laptop computer 124 may be desirable to present the electronic device, such as the laptop computer 124, and/or to accommodate consumer interaction with the laptop computer 124.

In an embodiment, the cable 90 may extend from the port 126 on the laptop computer 124 through the apparatus 10 and the cable assembly 74 to connect and/or attach to an alarm system to define a circuit. Disruption of the circuit via disconnection and/or removal of the sensor assembly 106 from the port 126 and/or from the alarm system may activate an alarm condition. The alarm condition may, for example, alert store employees to the unauthorized removal of and/or tampering with the laptop computer 124.

To arm and/or prepare the laptop computer 124 to be, for example, alarm-ready, the location of the port 126 may be identified on the laptop computer 124. For example, the port 126 may be located on a left side of the laptop computer 124 as shown in FIG. 2, and/or may be located on a right side of the laptop computer as shown in FIG. 3. The sensor assembly 106, attached to the cable 90, may be inserted into the port 126. The cable assembly 74 may be rotated to position the cable 90, threaded through the cable assembly 74, generally in the direction 130 to face the rear of the laptop computer 124. In an embodiment, a base section 122 may attach to a connector 68. The connector 68 may be registered jack (hereinafter "RJ") connector and/or a RJ-type connector. The connector 68 may be inserted into an alarm system to complete a circuit between, for example an alarm system, the cable 90 and the laptop computer 124. The alarm system may then be configured to an alarm-ready status. In an embodiment, multiple laptop computers 124 may be configured to an alarm-ready status.

Figure 4:
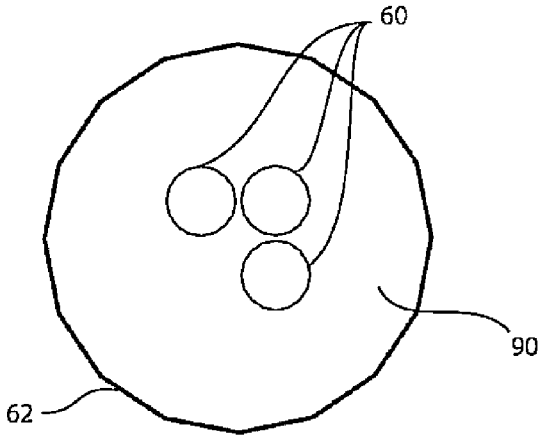
FIG. 4 illustrates a cross-sectional view of a cable in accordance with an embodiment of the present invention.

As illustrated in FIG. 4, a cross-section of the cable 90 is shown. The cable 90 may have several conductors 60. In an embodiment, the conductors 60 may be American Wire Gauge (hereinafter "AWG") standard size 28 wire conductors. The cable 90 may have a width of 0.110 in. (2.800 mm). The cable 90 may have an exterior surface 62 defined by one or more angled surfaces to assist in identification of the cable 90 and/or maneuverability of the cable 90. The cable 90 may transfer data and/or information from the sensor assembly 106 and/or the electronic device such as a laptop computer 124 to an alarm system. Removal of the sensor assembly 106 from the port 126 may disrupt and/or break a circuit formed by, for example, the laptop computer 124, the cable 90, and the alarm system to activate an alarm condition.

Figure 5:
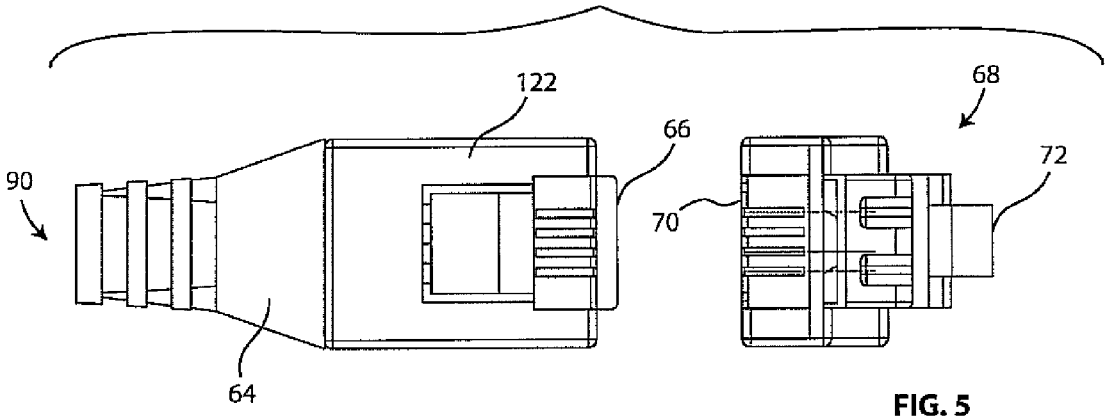
FIG. 5 illustrates a RJ-type connector in accordance with an embodiment of the present invention.

As illustrated in FIG. 5, the connector 68 is may be positioned at an end of the cable 90 that may be opposite to the end of the cable 90 that may be inserted into the cable assembly 74. In an embodiment, the connector 68 may be a RJ and/or a RJ-type connector. The connector 68 may be attached to the cable 90 by an overmold 64 that may cover the cable 90. The connector 68 may have a plug 66 that may extend from the base section 122 to enter into a jack 70. The jack 70 may have a reversibly compressible clip 72 at an end of the jack 70. The connector 68 may connect the cable 90 to an alarm system via insertion and/or attachment of, for example, the clip 72 into a suitable port in the alarm system to complete a circuit formed between the laptop computer, the cable 90, and the alarm system.

Figure 6:
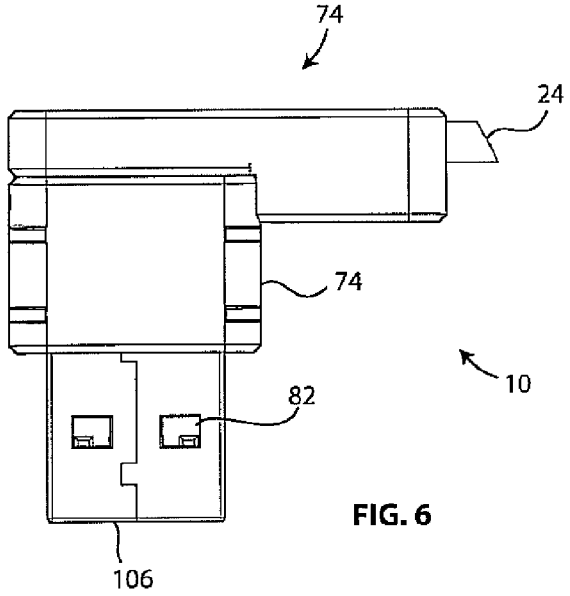
FIG. 6 illustrates a side view of a cable assembly with a sensor in accordance with an embodiment of the present invention.

As illustrated in FIG. 6, a top view of the apparatus 10 is shown with the cable assembly 74 oriented generally for left-sided use where, for example, the sensor assembly 106 may be inserted into a port located, for example, on the left side of a laptop computer while viewing the screen. As shown here, the sensor assembly 106 may have openings 82 located on a surface of the sensor assembly 106, such as the circuit board 30. The openings 82 may interact with and/or communicate with a port 126 on the laptop computer 124.

As illustrated in FIGS. 7 and 8, a side and top view of the cable 90 and sensor assembly 106 are shown, respectively. In an embodiment, the cable 90 may have a coil 94 to allow for transport of the cable 90 and/or to accommodate connecting to, for example, the port 126 on an electronic device such as, for example, the laptop computer 124 and/or an alarm system. The coil 94 may be expanded to accommodate longer distances between the laptop computer 124 and the alarm system, for example, and may recoil and/or shorten to conserve room when length is not required. Further, the cable 90 may have label 120 to identify the cable 90 to be associated with an alarm system. The label 120 may denote that, for example, detachment of the cable 90 from either an alarm system and/or an electronic device via the sensor assembly 106 may result in an alarm condition. In an embodiment, an identifying label and/or decal may be applied to the cable. In detail, the identifying label may be a "heat-shrink" type label, i.e. where a pre-formed label may expand upon heating to be applied to a surface, such as the cable 90, and shrink to a desired size on the surface upon later cooling. In an embodiment, the alarm condition may include audible, visual and/or vibratory signals. As shown in FIG. 7, the clip 72 may protrude at an angle from the base section 122 while the clip 72 may be, for example, uncompressed. The clip 72 may compress and subsequently relax and/or expand upon insertion and/or attachment to an alarm system via an RJ connector and/or RJ-type connector.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the present disclosure should be limited only by the attached claims.

The invention claimed is:

1. A method for connecting a cable from an alarm system to an electronic device to complete a circuit between the alarm system, the cable and the electronic device wherein disruption of the circuit causes the alarm system to activate an alarm condition, the method comprising the steps of:

identifying a port on the electronic device;

connecting the cable through a conduit in a cover of a cable assembly wherein the cable assembly is positioned adjacent to the alarm system;

routing the cable through the cable assembly and a housing wherein the housing is connected to the cable assembly by a hinge joint wherein the hinge joint rotates to position the cable away from the electronic device; and connecting a sensor associated with the housing to the port wherein the alarm condition deactivates the electronic device.

2. The method of claim 1 further comprising the step of:

activating an alarm condition upon removal of the sensor from the port.

3. The method of claim 1 further comprising the step of:

illuminating the sensor in the housing to signify the alarm condition.

4. The method of claim 1 further comprising the step of:

disrupting the circuit to activate the alarm condition upon removal of the cable from the alarm system.

5. The method of claim 1 further comprising the step of:

deactivating the sensor prior to detaching the sensor from the port.

6. The method of claim 1 further comprising the step of:

activating the alarm system to create an alarm-ready condition.

7. The method of claim 1 further comprising the step of:

depressing a plunger switch to close the circuit.

8. An apparatus for connecting a sensor assembly from an alarm system to an electronic device by a cable that attaches to a port of the electronic device to complete a circuit between the sensor assembly, the electronic device and the cable wherein disruption of the circuit causes the alarm system to activate an alarm condition, the apparatus comprising:

a cable assembly having a first side cover and a second side cover positioned opposite to the first side cover wherein the first side cover and the second side cover combine to define a conduit through which the cable extends into an interior of the cable assembly;

a joint connected to the first side cover and the second side cover wherein the joint rotates to position the cable through the conduit to face the electronic device;

a connector attached to the cable wherein the connector inserts into the alarm system; and a sensor in the sensor assembly wherein the sensor connects to the port of the electronic device.

9. The apparatus of claim 8 further comprising:

a light in the sensor assembly that illuminates the sensor assembly to indicate the alarm-ready condition of the circuit.

10. The apparatus of claim 8 further comprising:

a base section that covers the cable.

11. The apparatus of claim 8 further comprising:

a port in the electronic device to receive the sensor assembly wherein removal of the sensor assembly from the port activates the alarm condition.

12. The apparatus of claim 8 further comprising:

a housing to hold the sensor assembly.

13. The apparatus of claim 8 further comprising:

a coiled section that reduces a length of the cable wherein the cable extends from the alarm system to connect with the electronic device.

14. The apparatus of claim 8 further comprising:

a label applied to the cable assembly wherein the label is a heat-shrink type label.

15. A system for connecting a sensor to an electronic device, the system comprising:

a cable routed through a cable assembly toward a housing wherein the cable assembly has a conduit defined by a first side cover and a second side cover positioned opposite and attached to the first side cover wherein the cable has a length defined between a first end and a second end wherein the first end has the sensor that inserts into a port of the electronic device and the second end has a connector that inserts into an alarm system to define a circuit between the cable, the electronic device and the alarm system;

a hinge joint extending from the first side cover and the second side cover to the housing wherein the hinge joint rotates the cable routed through the first side cover and the second side cover to position the cable away from the electronic device; and a light in the housing wherein the light illuminates upon insertion of the cable into the alarm system and the port in the electronic device to signify an alarm-ready condition of the circuit.

16. The apparatus of claim 15 further comprising:

an alarm activated by disruption of the circuit.

17. The apparatus of claim 15 further comprising:

a conductor cord in the cable to supply power to the electronic device from the alarm system.

18. The apparatus of claim 15 further comprising:

a label that provides identifying information regarding the cable wherein the label is attached to the cable.

19. The apparatus of claim 15 further comprising:

an alarm activated by removal of the connector from the port of the electronic device.

20. The apparatus of claim 15 further comprising:

a plunger switch in the housing wherein depression of the plunger switch closes the circuit.

* * * * *